US006042481A

United States Patent [19]

Walker et al.

[11] Patent Number: 6,042,481

[45] Date of Patent: Mar. 28, 2000

[54] BRAIDED BILLARD CUE SLEEVE

[76] Inventors: Tommy Walker; Lee-Ann Sue Larson, both of 2300 Commonwealth, Chicago, Ill. 60614

[21] Appl. No.: 08/906,186

[22] Filed: Aug. 4, 1997

[51] Int. Cl.[7] ..... A63D 15/10

[52] U.S. Cl. ..... 473/43; 473/43; 473/46

[58] Field of Search ..... 473/43, 46

[56] References Cited

U.S. PATENT DOCUMENTS

| | | | |
|---|---|---|---|
| 529,731 | 11/1894 | Gschwendtner | 473/43 |
| 570,459 | 11/1896 | Cronin | 473/43 |
| 870,491 | 11/1907 | Callaghan | 473/43 |
| 1,092,189 | 4/1914 | Varian | 473/43 |
| 2,931,649 | 4/1960 | Furda | 473/43 |
| 3,416,794 | 12/1968 | Ciano | 473/43 |
| 3,534,959 | 10/1970 | Elswick | 473/43 |
| 4,064,563 | 12/1977 | Stokes | 473/43 |
| 4,147,346 | 4/1979 | Giannetti | 473/43 |

*Primary Examiner*—Jeanette Chapman
*Assistant Examiner*—M. Chambers
*Attorney, Agent, or Firm*—James W. Clement

[57] ABSTRACT

An elongated friction-reducing sleeve for a billiard cue shaft. The sleeve has an internal diameter and internal surface that together provide a close but freely slidable fit with the cue shaft. The sleeve has an external surface that the player's guide hand can firmly, comfortably and immovably contact as the player slides the cue shaft longitudinally through the sleeve to make a shot. Suitable, improved and preferred lengths for the friction-reducing sleeve are disclosed. The sleeve is constructed of a braided material formed from resilient monofilaments of a strong plastic polymeric material.

6 Claims, 1 Drawing Sheet

BRAIDED BILLARD CUE SLEEVE

FIELD OF THE INVENTION

The present invention relates to a device in the form of a specially constructed sleeve for the shaft of a billiard cue that acts to smooth the longitudinal movement of the cue relative to the guide hand of the billiard player.

BACKGROUND OF THE INVENTION

In using a billiard cue, a billiard player ordinarily (1) grasps the butt of the cue with one hand, (2) supports the cue shaft in the crotch between the thumb and forefinger of the other hand used as a guide (this hand being positioned on the surface of the billiard table), and (3) then moves the cue longitudinally relative to the guide hand with a short jab or thrusting motion. The smooth movement of the cue across the supporting surfaces of the guide hand is extremely critical in achieving accuracy in shooting. It is very important for this movement to be achieved with the least possible friction between the guide hand and the cue shaft.

A common method of reducing friction between the longitudinally moving cue shaft and the player's guide hand is to apply a dry lubricating powder to the portions of the guide hand with which the cue shaft comes into contact. This dry lubricant is typically a white chalk powder that is applied to the player's hand by rubbing the hand against a large cone-shaped cake of the chalk. Another method of reducing friction between the longitudinally moving cue shaft and the player's guide hand is to apply the lubricating powder or chalk to the cue shaft itself.

In either case, the powder must be applied frequently throughout play and is quite messy to use. For one thing, it is difficult to avoid getting the powder on the player's clothing. In addition, the powder tends to fall onto the surface of the billiard table and onto the floor on which the table is located. At the end of a session of billiards, both the felt covering on the billiard table and the floor surrounding the table are frequently covered with powder. To remove the lubricating powder, the billiard table must be brushed hard for a long period of time. Such hard brushing reduces the life of the felt covering on the table to a very significant extent.

Another means for reducing the friction between the longitudinally sliding cue shaft and the guide hand of the player is a billiard glove such as disclosed in Anast U.S. Pat. No. 1,362,461 issued Dec. 14, 1920, in Stokes U.S. Pat. No. 4,064,563 issued Dec. 27, 1977, and in Blakeman U.S. Pat. No. 4,103,362 issued Aug. 1, 1978. While such a glove is effective in smoothing the longitudinal movement of the cue across the guide hand of the billiard player, these gloves have failed to gain wide acceptance.

There are several reasons for this. Players' hands differ markedly in size, and the gloves are available in only a limited number of sizes. Even if the proper size glove is available, many players feel self-conscious about wearing the glove. Many other players do not like wearing the glove because it can interfere to an extent with the desired positioning of the guide hand on the surface of the billiard table. And to avoid slowing up play, the glove must be worn throughout the course of a game, even while the player is waiting for his or her turn to shoot.

The game of billiards in its various modern forms—English billiards (played with 3 balls and 6 pockets), French billiards (played with 3 balls and no pockets, also known as carom), pocket billiards (pool), and snooker (played with 21 balls, a cue ball and 6 small pockets)—has been known since the 19th century. The problems associated with the use of chalk powder have been known at least that long, and have continued to the present day. Another early effort to eliminate the described chalking problems was to hold a small sleeve or tube—which was constructed of a rigid material—in such a way that a billiard cue shaft with a uniform diameter could slide backward and forward within the sleeve or tube. This effort was made—as shown by Gschwendtner U.S. Pat. No. 529,731—as early as 1894. The patent in question stated (page 2, lines 4–12) that some of the materials from which the sleeve could be constructed were sheet metal (preferably aluminum), celluloid, vulcanized rubber and indurated (hardened) paper. Other billiard cue sleeves made of rigid material for use with a billiard cue shaft having a uniform diameter are disclosed in U.S. Pat. No. 1,092,189 issued to Varian in 1914 and in U.S. Pat. No. 3,534,959 issued to Elswick in 1970.

U.S. Pat. No. 3,416,794, issued to Ciano in 1968, discloses a billiard cue sleeve that is usable with cue shafts that are tapered, even though the sleeve is made of a substantially rigid material such as spring steel, because the sleeve has a split ring configuration (Ciano patent, col. 3, lines 43–49). U.S. Pat. No. 4,147,346, issued to Giannetti in 1979, also discloses a billiard cue sleeve that is usable with tapered cue shafts even though it is made of a rigid material, in this case because the two rigid members that comprise the sleeve are hinged to each other.

Still another early effort to eliminate the described chalking problems was to construct billiard cue sleeves of leather or similar materials. As seen from the specification in Callaghan U.S. Pat. No. 870,491, these sleeves were known at least as early as 1907, and actually considerably earlier than that. The Callaghan specification is silent as to the shape of the billiard cue shaft with which the sleeve was used, so it was apparently the conventional shape that had been known for a very long time—which tapered slightly and continuously from one end of the shaft to the other—and the sleeve was able to adapt to that taper. Since the patent describes a member that was positioned on the exterior of the sleeve for keeping the sleeve from sliding out of the user's hand as the only novel feature of the invention, it appears that sleeves constructed from a solid, continuous "relatively soft or yieldable substance" such as leather (Callaghan patent, page 1, lines 64–66)—and which did not include an externally positioned anti-sliding member—were known much earlier than 1907.

Still other devices designed to be used to support a billiard cue shaft in a friction-reducing manner, and which would at the same time avoid the described chalking problems, have been developed over the years. U.S. Pat. No. 570,459, issued to Cronin on Nov. 3, 1896, discloses a device that includes a bracket that supports a roller across which the cue shaft moves. The device disclosed in U.S. Pat. No. 2,931,649, issued to Furda on Apr. 5, 1960, includes a fulcrum block and an overlying resilient clamp plate that together form a passage through which the cue shaft moves.

During all the years just discussed, no one has suggested the present very effective invention. This, despite the fact that in all that time the games of pool and billiards have continued to be popular, efforts have continued to be made to improve the equipment used in those games, and the material of which the device of the present invention is constructed—sleeving formed of braided filaments or strands of various types of material—has been known for many years. (See, for example, the sleeving material disclosed in U.S. Pat. No. 2,393,530, issued to Harris Sep. 28, 1943.)

SUMMARY OF THE INVENTION

This invention comprises a friction-reducing sleeve, constructed of a braided material formed of smooth-surfaced filaments or strands, for positioning around a gradually tapered billiard cue shaft with a close but freely slidable fit.

The preferred embodiment of the friction-reducing sleeve of this invention is constructed of a material braided from resilient monofilaments of a strong plastic polymeric material such as a polyester.

In every case, the sleeve has an internal diameter and an internal surface that together provide a close but freely slidable fit between the sleeve and of the gradually tapered cue shaft.

The billiard cue sleeve has an external surface that the player's guide hand can firmly, comfortably and immovably contact, as the guide hand supports the friction-reducing sleeve and the shaft within the sleeve while the player moves the cue longitudinally to make a given shot.

In place around the cue shaft, the friction-reducing sleeve of this invention has a substantially circular transverse cross section.

The friction-reducing sleeve may usefully be between about 3 inches and about 12 inches in length. An over-all length between about 4 inches and about 8 inches is more suitable, and an over-all length of about 6 inches is preferred.

ADVANTAGES OF THE INVENTION

The present invention has a number of advantages.

This invention provides a reliable and effective means for smoothing the longitudinal movement of a billiard cue relative to the player's guide hand.

The friction-reducing sleeve of this invention is easily placed on the portion of the cue shaft that would otherwise be in contact with the player's guide hand, and can remain in that position on the cue shaft throughout the course of play.

The device leaves the player's guide hand completely free to be positioned most effectively on the surface of the billiard table. Among other things, this invention makes it easier for the player to position the guide hand in the standard closed bridge, in which the player's bent forefinger is aligned over the top of the cue shaft and the thumb is beneath the shaft.

In addition, the device prevents sweat, hand oil and grime—which adversely affect both the condition of the billiard cue and the smooth longitudinal movement of the cue—from collecting on the cue shaft.

The device is economical in cost.

It avoids the inconvenience of either applying a dry lubricant to the player's guide hand (with the accompanying messy table and floor) or wearing a glove on the hand.

The sleeve has the ability to expand and contract with the longitudinal movement of the billiard cue, so as to accommodate the conventional gradually tapered shape of the billiard cue shaft.

DETAILED DESCRIPTION OF PREFERRED EMBODIMENT

Position on Cue Shaft.

Figure 1:
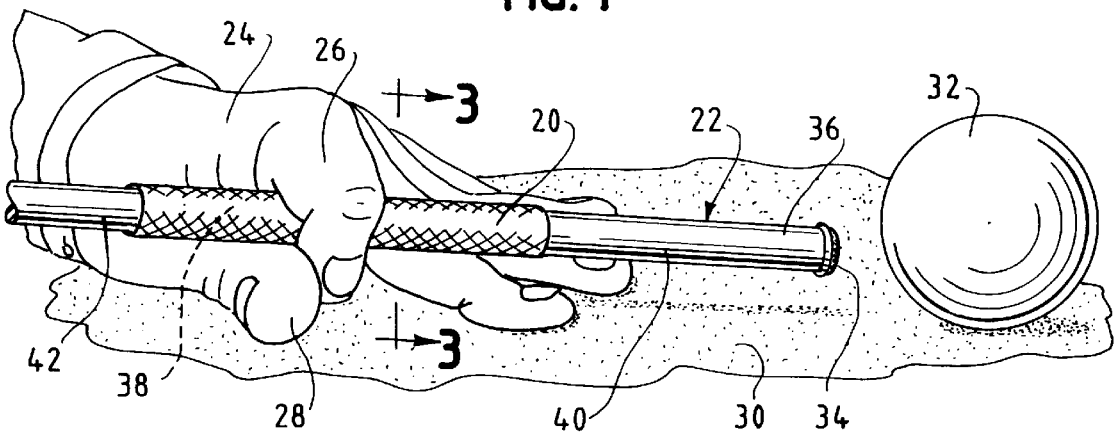
FIG. 1 is a perspective view of a portion of the billiard cue shaft and one embodiment of the friction-reducing sleeve of this invention, both supported on the guide hand of a billiard player.

FIG. 1 is a perspective view of a preferred embodiment of the friction-reducing sleeve 20 of this invention, shown in its operative condition positioned around gradually tapered cue shaft 22. The sleeve and cue shaft are held in the player's guide hand 24 between forefinger 26 and thumb 28. The player's guide hand rests upon the flat surface of billiard table 30. The player is preparing to make a shot by moving shaft 22 longitudinally forward relative to sleeve 20, to strike ball 32 with felt tip 34 of the cue.

Cue shaft 22 has a generally cylindrical shape, and tapers gradually from its largest diameter at its rear end (not shown in FIG. 1) to its smallest diameter at its front end 36. The shaft has a smooth external surface. The billiard cue is completed by the remainder of the cue shaft (which extends to the left of what is seen in FIG. 1) and by the butt portion of the cue (which extends still farther to the left).

Braided Sleeve of Smooth-Surfaced Strands

Figure 4:
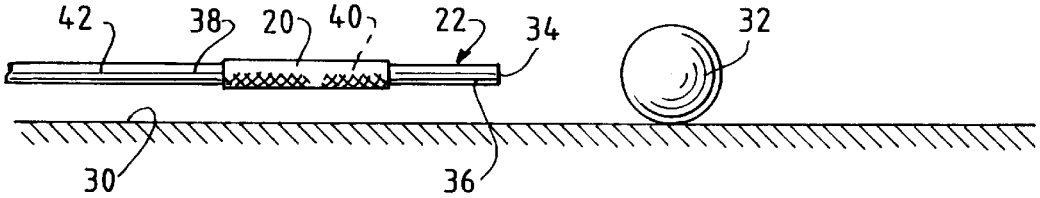
FIG. 4 is a side elevation of the friction-reducing sleeve of this invention in place around the billiard cue shaft, with the cue pulled back a short distance as the player is lining up a shot.

FIG. 4 illustrates how cue shaft 22 moves within sleeve 20 as the player pulls the cue shaft back through the sleeve in the first step of a shot. In FIG. 4, the player has pulled the cue back a short distance as the shot is being lined up. Since the sleeve is stationary, the backward movement of the cue shaft means that the sleeve has in effect moved forward on the shaft to overlie portion 40 of the shaft.

Figure 5:
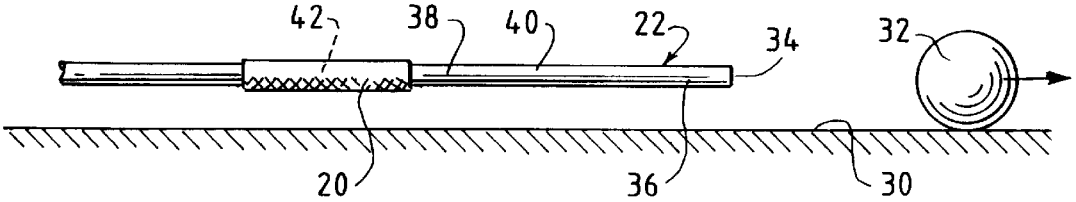
FIG. 5 is a side elevation of the same cue shaft and sleeve after the cue has been moved forward to strike the ball.

FIG. 5 illustrates how cue shaft 22 moves within sleeve 20 as the player moves the cue forward, to strike ball 32 and continue to a final follow-through position. Since the sleeve is stationary, the forward movement of the cue shaft means that the sleeve has in effect moved back upon the shaft to overlie portion 42 of the shaft. In FIG. 5, the cue has just struck the ball, and has come to rest in a follow-through position.

As illustrated in FIG. 1, friction-reducing sleeve 20 has the basic geometric shape of a one-piece right circular cylinder. It thus has substantially the same cross section the cue shaft has, i.e., a substantially circular transverse cross-section.

The friction-reducing sleeve of this invention is formed of any suitable material braided from smooth-surfaced filaments or strands. This construction (1) does not interfere with the smoothing of the longitudinal movement of the cue shaft with respect to the sleeve when the player makes a given shot, and (2) provides a firm, comfortable and immovable contact with the player's guide hand upon which the cue shaft and sleeve are supported.

Figure 2:
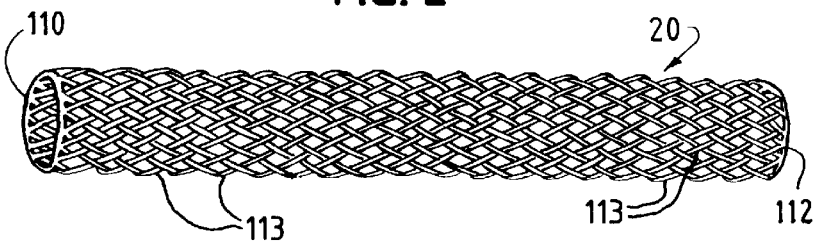
FIG. 2 is a perspective view of the sleeve shown in FIG. 1.
Figure 3:
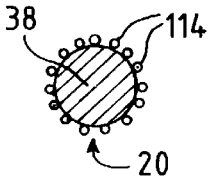
FIG. 3 is a cross section of the cue and sleeve of FIG. 1, taken along the line 3—3 in the latter Figure.

The preferred embodiment of the friction-reducing sleeve of this invention—sleeve 20 in FIG. 1—is formed of a braided material such as shown in FIG. 2. The material is braided from resilient monofilaments of a strong plastic polymeric material such as a polyester. Each sleeve is cut to the desired length with a hot knife or wire (as, for example, at the left-hand end 110 and right-hand end 112 of sleeve 20 in FIG. 2), which fuses the end portions of the monofilaments to each other and thereby prevents the braid from fraying or unraveling. Individual filaments 113 of the braided material are seen in the perspective view of FIG. 2 and in the cross-sectional view of FIG. 3. In FIG. 3, individual monofilaments 114 are indicated surrounding cue shaft 22.

Braided materials of various types have been used for many years in the production of sleeves to provide mechanical, electrical, flame or thermal protection—but not to provide a close but freely slidable fit—for various elongate objects such as pipes or tubes or, more especially, bundles of wire. (One example of such a braided material is the material made by Bentley-Harris Manufacturing Company and sold under the federally registered trademark Expando.) In particular, the use of such protective sleeves has not extended to friction-reducing sleeves for pool and billiard cues.

The braided material of which the friction-reducing sleeve of this invention is constructed results in the sleeve being slightly contractible radially when the cue shaft slides backward through the sleeve, and slightly expandable radially when the shaft slides forward through the sleeve. As will be understood, this property of the braided sleeve contributes to maintaining the smoothness with which the cue shaft slides through the sleeve.

The sleeve has an external surface against which the player's guide hand can be firmly, comfortably and immovably positioned as the player grasps the sleeve and shaft in the manner shown in FIG. 1, or merely supports the sleeve and shaft unconfined on the guide hand, while he or she makes a given shot.

If desired, the sleeve can be formed of a laminated material having two layers of different materials. For example, braided material formed of resilient monofilaments of a strong plastic polymeric material, which is best adapted to provide a freely slidable action with the smooth cue shaft, can form the inner layer. Another material, best adapted for contact with the guide hand, can form the outer layer, so long as it does not interfere with the contractibility and expandability of the braided material.

Internal Diameter and Close but Freely Slidable Fit

As explained above in connection with FIGS. 4 and 5, cue shaft 22 moves forward and backward within sleeve 20 as the player makes a shot. Sleeve 20 has an internal diameter that provides a close but freely slidable fit between the sleeve and longitudinal portion 38 of cue shaft 20. Longitudinal portion 38 is coextensive with sleeve 20, and is hidden by the sleeve in FIG. 1. (The exact location of shaft portion 38 for any given shot depends upon the initial position in which the player places the billiard cue when preparing to make the shot.) As will be seen, this predetermined portion of the shaft is moved by the player longitudinally, relative to guide hand 24 and within sleeve 20 positioned on the guide hand, as the player makes a given shot.

The length of longitudinal portion 38 of the cue shaft is determined by the over-all length of the friction-reducing sleeve. The sleeve can suitably have an over-all length between about 3 inches and about 12 inches. An over-all length between about 4 inches and about 8 inches is more convenient. An over-all length of about 6 inches provides a very effective smoothing action, along with greater ease and convenience of handling, and is therefore preferred. The length of shaft portion 38 is equal to the over-all length that is selected for the sleeve.

In addition to providing a close but freely slidable fit with portion 38 of the cue shaft, the internal diameter of sleeve 20 provides a close but freely slidable fit between sleeve and smaller diameter portion 40 and larger diameter portion 42 of the gradually tapered shaft—located, respectively, immediately in front of and immediately behind portion 38—, which also move through the sleeve as a shot is made.

Interconnected shaft portions 38, 40 and 42 are commonly moved by the player both backward and forward to a limited extent (in a kind of pumping action) as the player prepares to make a given shot. The cue is then moved forward the full extent necessary to execute the particular shot being made. The length of portions 40 and 42 of the cue shaft depend upon (1) the length of longitudinal portion 38, and (2) the probable maximum lengths of the backward and forward movements just described (in other words, the maximum distance the cue shaft slides within the sleeve in each direction).

These latter distances depend on the size of the player and on the type of shot to be made. In any type of shot, a taller player typically moves the cue a greater distance than shorter players do. With any size player, soft shots require relatively little movement of the cue, while in pool, for example, the first shot of the game—to "break" the balls from their triangular arrangement after they have been "racked up" to start the game—requires the most power and the greatest movement of the cue.

Maximum internal diameter. The internal diameter of the friction-reducing sleeve of this invention, when the sleeve is in its operative position encircling portion 38 of cue shaft 22, is not substantially greater than the largest diameter of portion 42 of the shaft, which is located in the rearward most position on the cue shaft to which the sleeve moves as a result of the forward movement of the cue.

The largest diameter of rear portion 42 of cue shaft 22 will depend on the rate of outward taper of the shaft from front to back. The shaft of a billiard cue generally tapers outward very gradually in the forward half, and at a somewhat greater rate (although still quite gradually) in the rear half, next to the thicker butt portion of the cue. The exact rate of taper may vary from one manufacturer to another. In fact, when requested, custom cue makers will taper a shaft to a customer's personal specifications, so the taper of the shaft in such a cue may be unique.

In addition to having an internal diameter as described, friction-reducing sleeve 20 has an internal surface relative to which the external surfaces of portion 38 of the billiard cue shaft and of adjacent portions 40 and 42 of the shaft are freely slidable.

Use of Friction-Reducing Sleeve

Since the sleeve of this invention can be left on the cue shaft indefinitely, whether during or after play, it is effectively a part of the billiard cue itself. In such case, the complete billiard cue includes a butt portion that is grasped by one of the player's hands, a shaft portion as described above that forms the front end portion of the billiard cue, and a friction-reducing sleeve as described.

As illustrated in FIG. 1, use of the above described friction-reducing sleeve can also be considered as part of a method of making a shot in any of the various forms of the game of billiards. As a first step in the method, friction-reducing sleeve 20 is positioned around longitudinal portion 38 of cue shaft 22 to form a close but freely slidable fit between the sleeve and portion 38 of the shaft, and with immediately adjacent portions 40 and 42 of the shaft as well. A right-handed player grasps the butt portion of the cue with his or her right hand. The player then places guide hand 24 on flat surface 30 of the billiard table, to guide the longitudinal movement of the cue shaft on the hand during the making of the shot.

Friction-reducing sleeve 26 and the cue shaft within it are placed in the crotch between forefinger 26 and thumb 28 of guide hand 24. As indicated above, the player commonly moves the cue shaft a short distance backward and then slides it forward smartly, with the friction-reducing sleeve supported on the guide hand, for whatever distance is necessary to strike a ball 32 with cue tip 34 and complete the follow-through of the shot. During both the backward and forward movements of the billiard cue, friction-reducing sleeve 20 remains stationary relative to the player's guide hand.

The present invention has been described above and illustrated in the accompanying drawing in connection with the best mode presently contemplated by the inventors for carrying out their invention. The embodiment described and shown is for the purpose of illustration only, and is not to be construed as constituting any limitation of the invention. Modifications will be obvious to those skilled in the art, and all modifications that do not depart from the spirit of the invention are intended to be included within the scope of the appended claims.

We claim:

1. A combination of:

a billiard/pool cue, said cue having a butt portion and a generally cylindrical shaft, said shaft extending forward from said butt portion and having a smooth external surface and tapering gradually from its largest diameter at its rear end to its smallest diameter at its front end, and a device for smoothing backward and forward longitudinal movement and direction relative to a player's guide hand positioned on a surface of the billiard table, of said generally cylindrical cue shaft, which said device comprises:

an elongated friction-reducing sleeve for positioning around said billiard cue shaft, said sleeve:

(a) is constructed of a braided material formed of smooth-surfaced strands;

(b) is contractible and expandable radially as said cue shaft slides longitudinally through said braided sleeve in said backward and forward directions, respectively;

(c) has (i) a substantially circular transverse cross section, (ii) an internal diameter and (iii) an internal surface that together provide a close but freely slidable fit of said sleeve with said gradually tapered cue shaft, as said shaft moves longitudinally relative to said player's guide hand and said sleeve;

(d) and said sleeve having an over all length between 3 inches and 12 inches.

2. The combination of claim 1 in which said elongated friction reducing sleeve has an over-all length between 4 inches and 8 inches.

3. The combination of claim 2 in which said elongated friction-reducing sleeve has an over-all length of 6 inches.

4. The combination of claim 1 in which said braided material of which said elongated fiction-reducing sleeve is constructed is formed of a plurality of resilient monofilaments of a strong plastic polymeric material.

5. The combination of claim 4 in which said elongated friction-reducing sleeve has an over-all length between 4 inches and 8 inches.

6. The combination of claim 5 in which said elongated friction-reducing sleeve has an over-all length of 6 inches.

* * * * *